US005291714A

United States Patent [19]

Wright et al.

[11] Patent Number: 5,291,714

[45] Date of Patent: Mar. 8, 1994

[54] GRATING ASSEMBLY

[75] Inventors: Bruce H. Wright, Spring Grove, Ill.; George Gillis, Cascade, Wis.

[73] Assignee: Architectural Gratings & Grillwork, Inc., Spring Grove, Ill.

[21] Appl. No.: 921,004

[22] Filed: Jul. 28, 1992

[51] Int. Cl.[5] ..... E04C 2/42

[52] U.S. Cl. ..... 52/664; 52/668; 52/180

[58] Field of Search ..... 52/662, 663, 664, 180, 473; 52/666, 667, 668; 47/25, 32

[56] References Cited

U.S. PATENT DOCUMENTS

| | | | |
|---|---|---|---|
| 1,591,328 | 7/1926 | Lachman | 52/664 |
| 4,221,038 | 9/1980 | Singer et al. | 52/664 |
| 4,282,695 | 8/1981 | Lew | 52/664 |
| 5,003,724 | 4/1991 | Vestuti | 47/25 |

FOREIGN PATENT DOCUMENTS

| | | | |
|---|---|---|---|
| 319224 | 3/1920 | Fed. Rep. of Germany | 52/664 |
| 2518441 | 11/1976 | Fed. Rep. of Germany | 47/32 |
| 0121540 | 9/1979 | Japan | 52/664 |

*Primary Examiner*—Carl D. Friedman
*Assistant Examiner*—Christopher T. Kent

[57] ABSTRACT

A grating assembly comprising end rails, substantially J-shaped, with a bottom, outside wall and substantially parallel inside wall, about one-half the height of the outside wall. The inside wall is formed with slots to hold intermediate spacer bars that support tread rails which are in a spaced relation to one another.

6 Claims, 6 Drawing Sheets

GRATING ASSEMBLY

BACKGROUND OF THE INVENTION

The invention relates generally to floor gratings, particularly those utilized in the entrances to buildings and the like. Typically, the gratings comprise rigid tread rails typically formed of metal arranged in a side by side series, with a narrow space between the rails to allow for the passage of water, slush and dirt. The rails are rigidly secured and are recessed in the floor surface, so as to form a substantial continuation of the floor surface. In the recess area of the floor where the grating is supported there may also be included a drain for removal of excess water, dirt and slush.

It has been customary to construct floor gratings with the structural element extending both transversely and longitudinally. Typically, the grating structure is formed of a plurality of tread-supporting members, arranged in a side by side relation, usually spaced from each other. These elements, which are normally extended transversely, are rigidly joined by a plurality of longitudinally extending locking bars which secure the assembly of tread supports in the desired spaced relation and with a desired degree of rigidity.

Floor grating assemblies are well known in the art. The Berndt U.S. Pat. No. 4,903,444, Bustin U.S. Pat. No. 4,027,451, Viehmann et al. U.S. Pat. No. 3,383,822 and the Reifsnyder U.S. Pat. No. 4,112,640 are representative of known floor grating structures. The latter two references illustrate common techniques of construction wherein the tread rails are aligned with openings for the reception of a plurality of spacing bars arranged to extend transversely from one side of the assembly to the other. The spacing bars are inserted into tread rail openings in a predetermined rotational orientation and rotated into a locking position so that the tread rails are in a desired spaced relation.

Among the disadvantages of the known constructions of grating structures is the comparative difficulty of assembly. The necessity of first aligning and spacing structural elements or tread supports in order to receive connecting elements arranged at right angles thereto would necessitate an elaborate assembly procedure.

The present invention is directed to improvements in the construction of floor grating structures. The structure of the present invention provides for improved and simplified spacing bar arrangement which supplies adequate support and facile construction.

SUMMARY OF THE INVENTION

It is an object of the present invention, therefore, to provide structural improvements in the spacing bar which creates an improved and simplified spacing bar arrangement.

Another object of the present invention is the provision of a support grating which is capable of supporting heavy loads without sagging and without impeding the flow of water, slush and dirt therethrough.

A still further object of the present invention is to provide a circular floor grating assembly that may be utilized under revolving doors or as a grate around a tree planted adjacent to pavement.

These objects and others not enumerated are shown in a grating assembly comprising a plurality of end rails each having a bottom and spaced parallel upwardly extending outside and inside walls, similar to a J-shaped structure, the inside wall containing a plurality of slots and being about one half the height of the outside wall. A plurality of tread rails each having a first end and a second end are arranged in a closely spaced relation. The first end of the tread rail engages the outside wall of the end rail and is secured in a slot in the inside wall of the end rail. The second end of the tread rail is secured in a slot in the inside wall of an opposed end rail while engaged in the outside wall of the opposed end rail. Further, a plurality of intermediate space or support bars engages the tread rails between the end rails.

In addition to the above mentioned variety of advantages, some individual components such as the J-shaped end rail can be easily standardized, which means that the invention is suited for mass production.

Other objects and features of the invention will become apparent in the course of the following description with the accompanying drawings.

DESCRIPTION OF A PREFERRED EMBODIMENT

Figure 1:
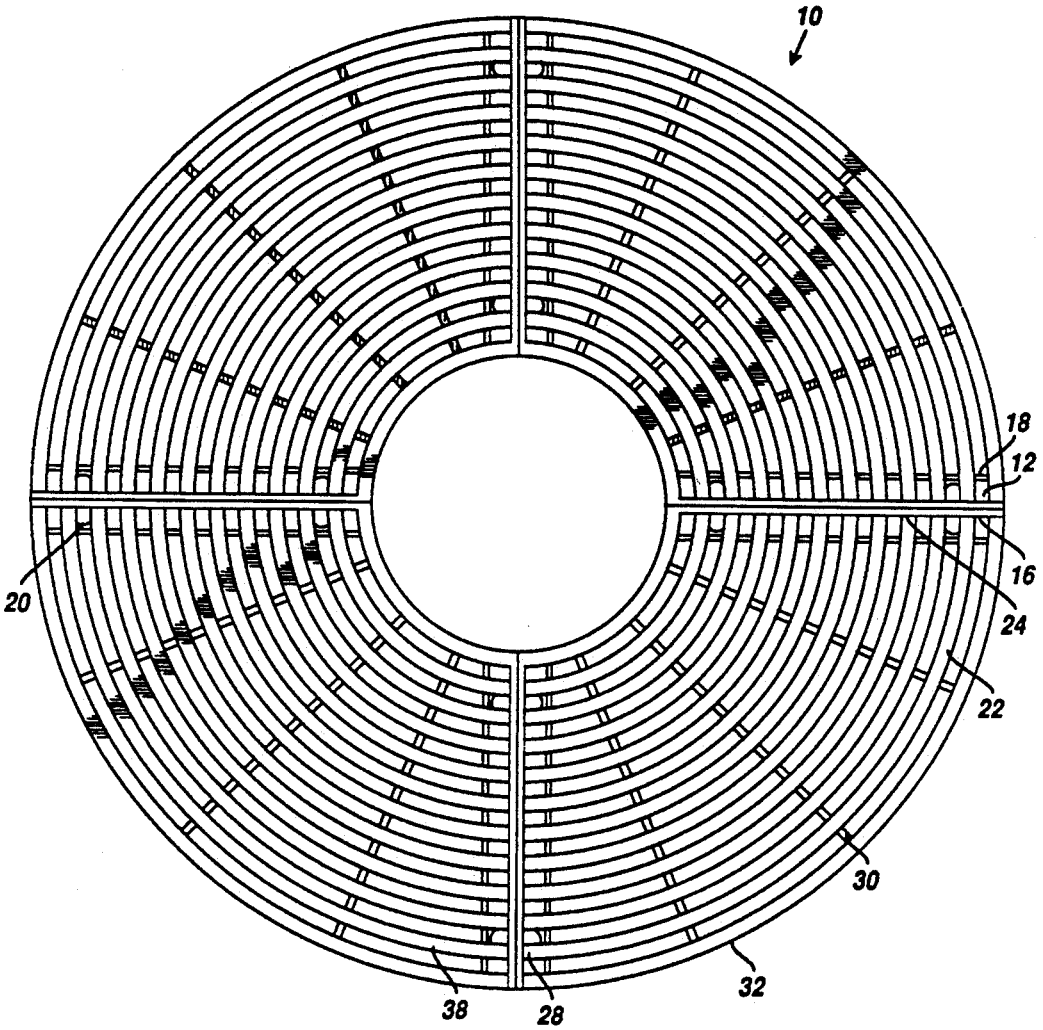
FIG. 1 is a top view of a circular grate comprising four sections.

Referring to FIG. 1, there is designated generally by the reference numeral 10 a top view a floor grating assembly structured in accordance with the invention. Grating 10 includes a plurality of end rails 12, each having a bottom 14 and spaced parallel upwardly extending outside 16 and inside 18 sidewalls. End rail 12 is shaped substantially as a J. Apertures 20 are placed in the bottom 14 of the end rail for drainage onto a floor, not shown, or compartment leading to a drain, which is also not shown.

Figure 2:
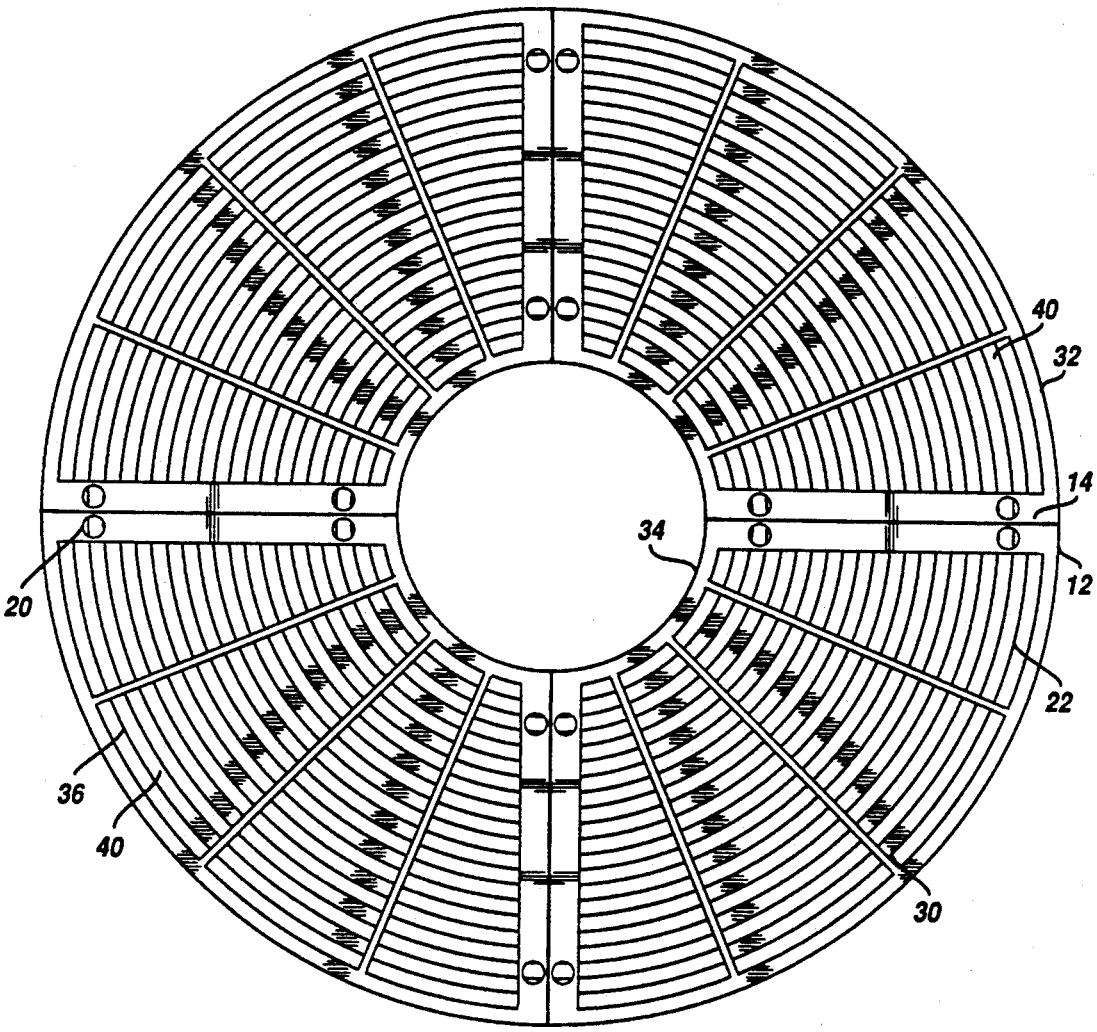
FIG. 2 is a bottom view of the same circular grate as shown in FIG. 1.

In the embodiment shown in FIGS. 1-2, a circular shape of a grating assembly is shown. In this configuration, outside side walls 16 abut each other. This embodiment can be placed below a revolving door or possibly used as a grating assembly around trees that are adjacent pavement.

A plurality of tread rails 22 are supported for the top surface of the grating assembly, level with a floor, not shown. Tread rails are arranged in a closely spaced side by side relation. A first end 24 of the tread rail 22 engages outside wall 16 of end rail 12. It is securely supported in slot 26 which is formed in inside wall 18 of end rail 12. Slot 26 properly aligns tread rail 22 so that the second end 28 of the end rail engages slot 26 on inside wall 18 and outside wall 16 on opposed end rail 12(*a*).

Figure 3:
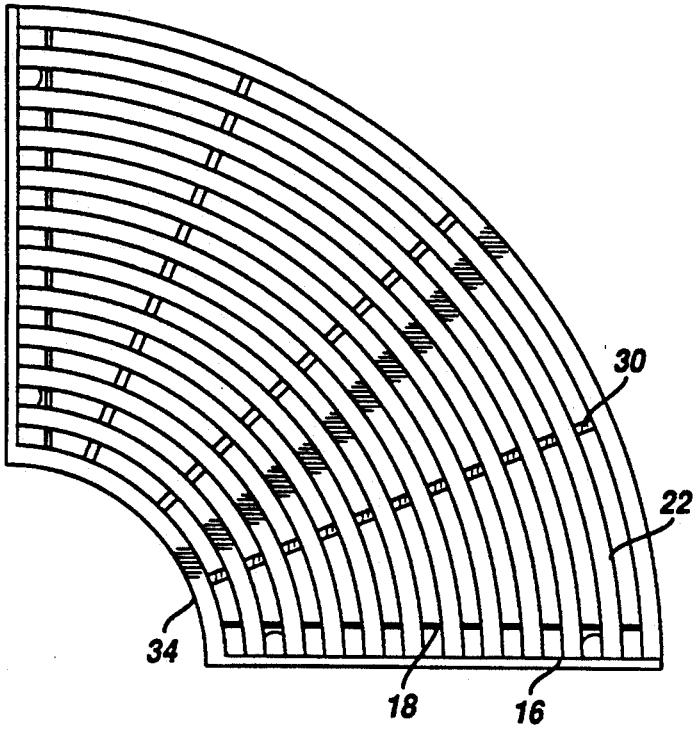
FIG. 3 is a top view of one section.
Figure 4:
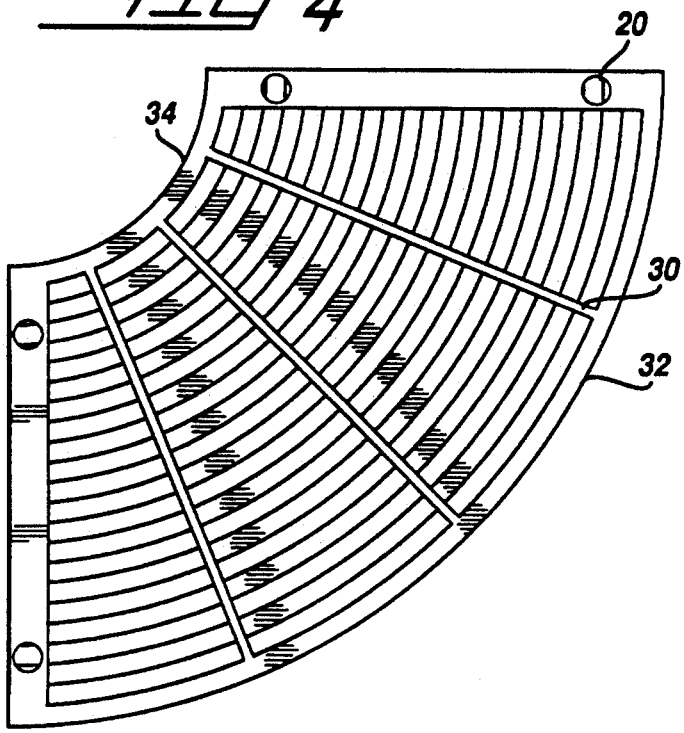
FIG. 4 is a bottom view of one section.
Figure 5:
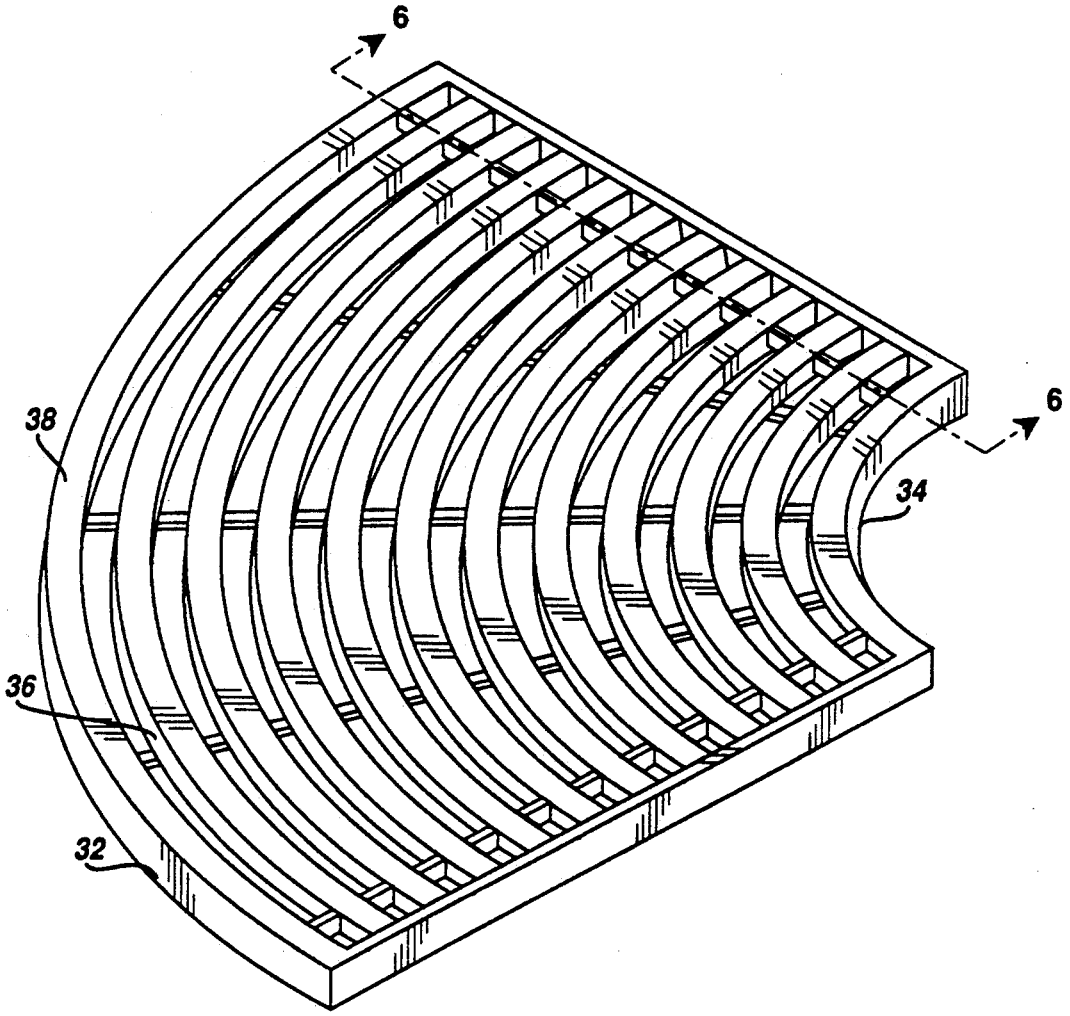
FIG. 5 is a perspective view of one grate section.
Figure 6:
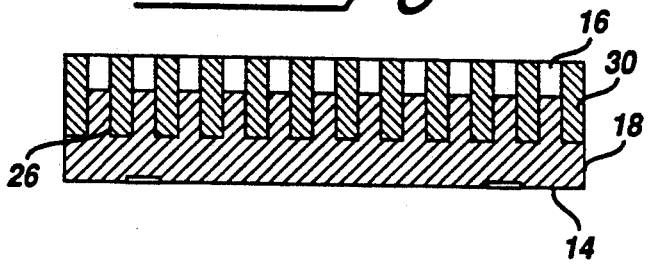
FIG. 6 is a cross section of the J-shaped end rail taken at Line 6—6 of FIG. 5.
Figure 7:
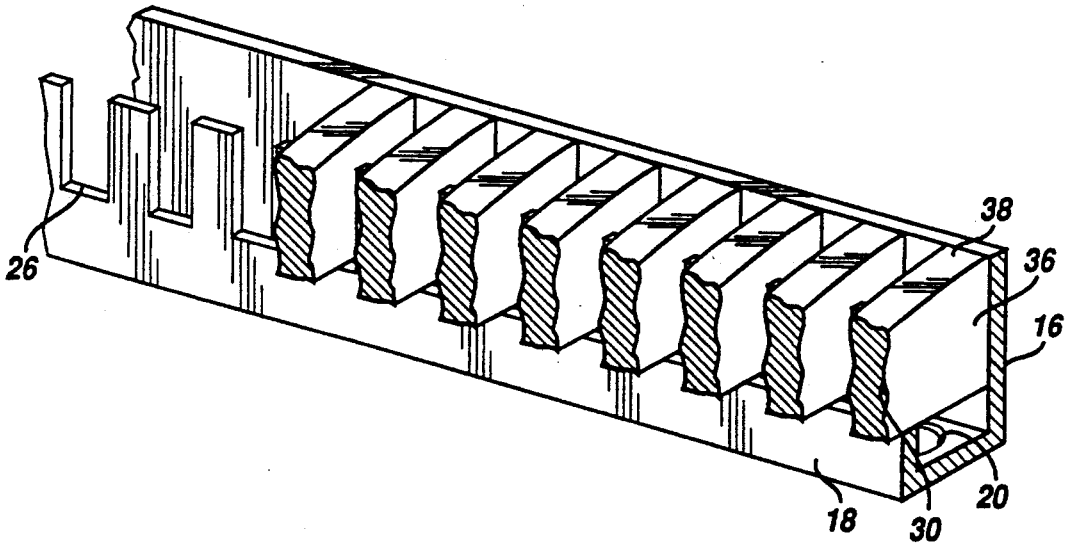
FIG. 7 is a partial cross section and partial cut away of the J-shaped end rail.
Figure 8:
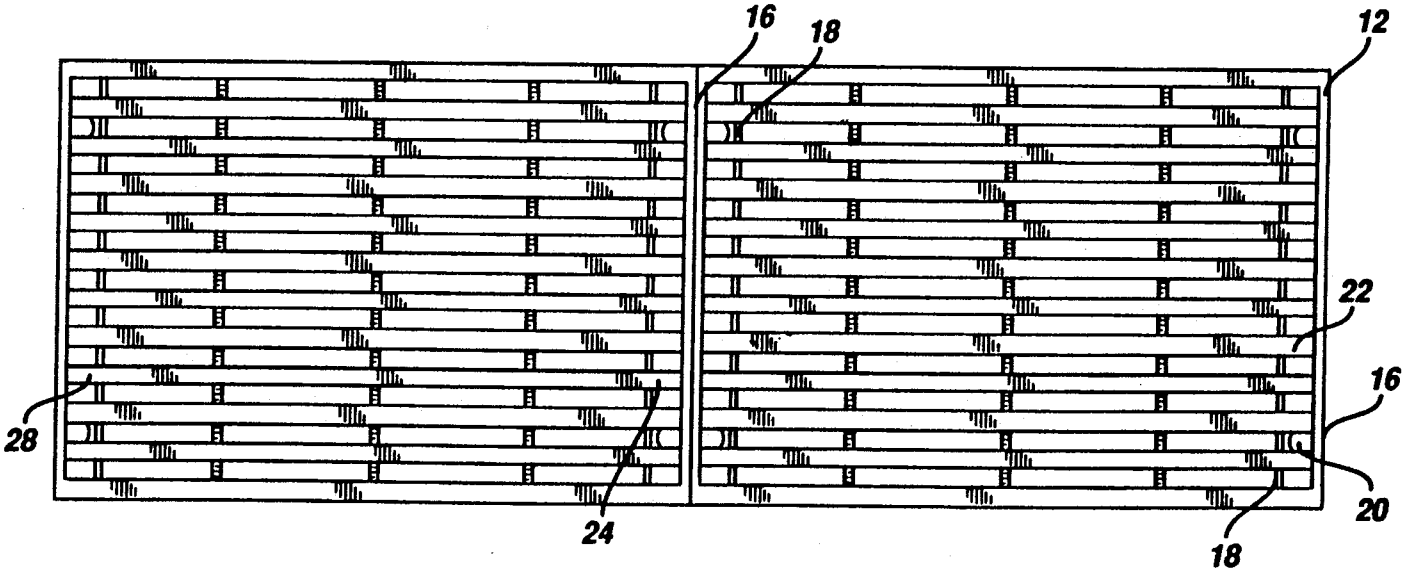
FIG. 8 is shows an alternate embodiment of the present invention, a rectangular grate.

Tread rails 26, shown in FIGS. 1-5 have external wall 32 on the outermost tread rail and internal wall 34 on the innermost tread rail formed into end rail 12 by welding or other suitable attachment procedure. Tread rail 26 have side walls 36, top surface 38 and bottom 40. The bottom 40 is secured to intermediate spacer bars 30 for support. The spacer bars 30 run transversely across the bottom of tread rail 22 and may be engaged to the tread rail by welding or any similar attachment procedure. The bars may extend the full radius or partial radius commencing at the external 32 or internal wall 34 of the respective tread rails. Sections of the circular design are shown in FIGS. 3–5. With no intention to be limiting, other shapes of the grating assembly can be structured, such as a rectangular design shown in FIG. 8. In joining sections, such as 45° sections of the grating assembly to form a circular design, adjacent end rails may be joined by any suitable attachment procedure, such as welding or the like.

Materials used for the construction of the grating assembly may be any suitable material that can provide the necessary support for the intended use. Typically the material may be selected from the group consisting of aluminum, brass, steel, stainless steel, bronze and the like. Preferably, stainless steel is used. Top surface 38 of the tread rails may be burred or smoothed in any suitable manner so that weld marks or any scratches from the attachment of the tread rails 22 to the end rail 12 or spacer bars 30 is not shown.

It will be evident to those skilled in the art that the grating assembly in accordance with the present invention provides economies in manufacture, assembly and design. One embodiment, the circular design, is partially difficult to manufacture by conventional techniques. It should be understood that the specific forms of the invention herein illustrated, described, and claimed may be modified by those having skill in the art without departing from the spirit and scope thereof.

What is claimed is:

1. A grating assembly comprising:

(a) a plurality of pairs of end rails each in an opposed relationship and each having a bottom and a spaced parallel upwardly extending outside wall having a specified height and an inside wall the inside wall containing a plurality of slots, said inside wall being about one-half the height of the outside wall;

(b) a plurality of tread rails each having a first end and a second end said tread rails being arranged in a closely spaced relation, the first end engaging the outside wall of an end rail and being secured in a slot in the inside wall of the end rail, the second end of the tread rail being secured in a slot in the inside wall of an opposed end rail and engaging the outside wall of the opposed end rail; and (c) a plurality of intermediate spacer support bars engaging the tread rails between the end rails.

2. A grating assembly according to claim 1 wherein the bottom each end rail has openings for passage of fluid and solid particles.

3. A grating assembly according to claim 1 wherein the tread rails have a smooth top surface.

4. A grating assembly according to claim 1 wherein the assembly is a sector and is curved through an angle of substantially 90 degrees.

5. A grating assembly according to claim 4 wherein a plurality of assemblies are engaged to form a substantially circular design.

6. A circular grating assembly comprising:

(a) a plurality of pairs of J-shaped end rails each in an opposed relationship and each having a bottom and a spaced parallel upwardly extending outside wall having a specified height and an inside wall, the inside wall containing a plurality of slots, said inside wall being about one-half the height of the outside wall;

(b) a plurality of tread rails each having a first end and a second end, said tread rails being arranged in a closely spaced relation, the first end engaging the outside wall of an end rail and being secured in a slot in the inside wall of the end rail, the second end of the tread rail being secured in a slot in the inside wall of an opposed end rail while engaging the outside wall of the opposed end rail; and (c) a plurality of intermediate spacer support bars engaging the tread rails between the end rails.

* * * * *